US007678522B2

(12) United States Patent
Nakamura et al.

(10) Patent No.: US 7,678,522 B2
(45) Date of Patent: Mar. 16, 2010

(54) TONER, AND DEVELOPER, IMAGE FORMING METHOD, IMAGE FORMING APPARATUS, AND PROCESS CARTRIDGE USING THE TONER

(75) Inventors: Minoru Nakamura, Takarazuka (JP); Chiyoshi Nozaki, Ohtsu (JP); Tsuyoshi Nozaki, Ikeda (JP); Atsushi Yamamoto, Kawanishi (JP)

(73) Assignee: Ricoh Company Limited, Tokyo (JP)

( * ) Notice: Subject to any disclaimer, the term of this patent is extended or adjusted under 35 U.S.C. 154(b) by 305 days.

(21) Appl. No.: 11/674,244

(22) Filed: Feb. 13, 2007

(65) Prior Publication Data

US 2007/0190442 A1 Aug. 16, 2007

(30) Foreign Application Priority Data

Feb. 14, 2006 (JP) ..... 2006-036864

(51) Int. Cl.
*G03G 9/08* (2006.01)

(52) U.S. Cl. ..... 430/108.4; 430/109.4; 430/110.2; 430/111.4; 430/123.5

(58) Field of Classification Search ..... 430/108.4, 430/109.4, 110.2, 111.4, 123.5
See application file for complete search history.

(56) References Cited

U.S. PATENT DOCUMENTS

| | | | | |
|---|---|---|---|---|
| 5,639,584 | A * | 6/1997 | Anno et al. | 430/137.18 |
| 6,265,125 | B1 * | 7/2001 | Anno et al. | 430/107.1 |
| 7,378,213 | B2 * | 5/2008 | Tomita et al. | 430/124.3 |
| 2004/0142265 | A1 | 7/2004 | Tomita et al. | |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |

FOREIGN PATENT DOCUMENTS

| | | |
|---|---|---|
| JP | 2001-22117 | 1/2001 |
| JP | 2001-154457 | 6/2001 |
| JP | 2003-29467 | 1/2003 |
| JP | 2004-318043 | 11/2004 |

OTHER PUBLICATIONS

U.S. Appl. No. 11/851,617, filed Sep. 7, 2007, Murakami et al.
U.S. Appl. No. 11/854,783, filed Sep. 13, 2007, Nakamura et al.
U.S. Appl. No. 11/924,994, filed Oct. 26, 2007, Katoh et al.
U.S. Appl. No. 11/857,175, filed Sep. 18, 2007, Matsumoto et al.
U.S. Appl. No. 12/017,853, filed Jan. 22, 2008, Masumoto et al.
U.S. Appl. No. 12/026,057, filed Feb. 5, 2008, Nozaki et al.
U.S. Appl. No. 12/035,892, filed Feb. 22, 2008, Kadota et al.
U.S. Appl. No. 12/046,784, filed Mar. 12, 2008, Nozaki et al.
U.S. Appl. No. 12/046,866, filed Mar. 12, 2008, Matsumoto et al.
U.S. Appl. No. 12/048,689, filed Mar. 14, 2008, Kadota et al.
U.S. Appl. No. 12/049,719, filed Mar. 17, 2008, Yamamoto et al.
U.S. Appl. No. 12/050,663, filed Mar. 18, 2008, Izutani et al.
U.S. Appl. No. 12/050,963, filed Mar. 19, 2008, Ishikawa et al.
U.S. Appl. No. 12/043,633, filed Mar. 6, 2008, Nakamura et al.
U.S. Appl. No. 12/046,869, filed Mar. 12, 2008, Nozaki et al.
U.S. Appl. No. 11/779,648, filed Jul. 18, 2007, Yamamoto et al.
U.S. Appl. No. 12/172,378, filed Jul. 14, 2008, Yamamoto et al.
Polymer Handbook 4$^{TH}$ Edition, Wiley-Interscience, vol. 2, Section VII (Table 9 Hansen Solubility Parameters of liquids 25° C., Jan. 1999.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

A toner is provided prepared by a wet granulation method, comprising a binder resin and a colorant, wherein the toner adsorbs ammonia ($NH_3$) in an amount of from 70 to 400 μmol/m$^2$ per unit of specific surface area and carbon dioxide ($CO_2$) in an amount of not greater than 10 μmol/m$^2$ per unit of specific surface area.

20 Claims, 2 Drawing Sheets

TONER, AND DEVELOPER, IMAGE FORMING METHOD, IMAGE FORMING APPARATUS, AND PROCESS CARTRIDGE USING THE TONER

BACKGROUND OF THE INVENTION

1. Field of the Invention

The present invention relates to a toner for use in electrophotography. In addition, the present invention also relates to a developer, an image forming method, an image forming apparatus, and a process cartridge using the toner.

2. Discussion of the Background

For the purpose of improving quality of electrophotographic images, recently toners are being modified to have a smaller particle diameter. The smaller particle diameter a toner has, the lower fluidity the toner has. When a toner has poor fluidity, the toner tends to aggregate and transferability thereof deteriorates. As a result, hollow defects tend to occur in the resultant image. In particular, this phenomenon notably occurs in a toner including a release agent (such as a wax) so as to prevent occurrence of a paper winding problem and an offset problem. The paper winding problem is a phenomenon in which a transfer medium having a toner image thereon is wound around a fixing member or gets stuck to a separation pick, due to adhesion of the toner image thereto. The offset problem is a phenomenon in which a part of a fused toner image is adhered and transferred to the surface of a fixing member, and then the part of the toner image is re-transferred to an undesired portion of a transfer medium. Deterioration of transferability notably occurs in toners for use in full-color image forming apparatuses.

When fluidity of a toner decreases, the occurrence of contact with a charge giving member (such as a carrier) decreases, and therefore the toner cannot be evenly charged. As a result, background fouling tends to occur in the resultant image. In particular, this phenomenon notably occurs in a toner including a release agent (such as a wax). Background fouling is a phenomenon in which the background portion of an image is soiled with toner particles which are not sufficiently charged, at a time when an electrostatic latent image formed on a photoreceptor is developed with a toner. Deterioration of chargeability notably occurs in toners for use in full-color image forming apparatuses.

In attempting to solve these problems, published unexamined Japanese patent application No. (hereinafter referred to as JP-A) 2001-154457 discloses an image forming apparatus including a combination of a magnetic brush formed of magnetic particles having a volume resistivity of from $10^4$ to $10^9$ Ω·cm and a toner having an acid value of from 3 to 40 mgKOH/g. It is described therein that such an image forming apparatus hardly produces abnormal images such as toner scattering and fogging.

JP-A 2003-29467 discloses a developer including a carrier of which a cover layer includes an oxime group in an amount of from 0.1 to 200 ppm based on total weight of the cover layer, and a toner having an acid value of from 5 to 50 mgKOH/g. It is described therein that such a developer can produce high quality images for a long period of the time.

However, these attempts are insufficient to prevent deterioration of transferability, when a multiple toner image formed on an intermediate transfer medium is transferred on a transfer medium in a full-color image forming apparatus.

On the other hand, in order to increase fluidity of a toner, a method in which the added amount of an external additive (such as silica) is increased is known. However, chargeability of the resultant toner changes with long-term use, resulting in the occurrence of background fouling. When the added amount of an external additive is too large, the external additive tends to migrate to the surface of a photoreceptor. A toner also tends to accumulate on the surface of the photoreceptor, while the external additive serves as a core. As a result, image noises such as black spots tend to occur in the image produced.

SUMMARY OF THE INVENTION

Accordingly, an object of the present invention is to provide a toner having good fixability in an oil less heat fixing process without contaminating a photoreceptor.

Another object of the present invention is to provide a developer, an image forming method, an image forming apparatus, and a process cartridge that can produce high quality images.

These and other objects of the present invention, either individually or in combinations thereof, as hereinafter will become more readily apparent can be attained by a toner prepared by a wet granulation method, comprising:

a binder resin; and a colorant, wherein the toner adsorbs ammonia ($NH_3$) in an amount of from 70 to 400 μmol/$m^2$ and carbon dioxide ($CO_2$) in an amount of not greater than 10 μmol/$m^2$ per unit of specific surface area; and a developer, an image forming method, an image forming apparatus, and a process cartridge using the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
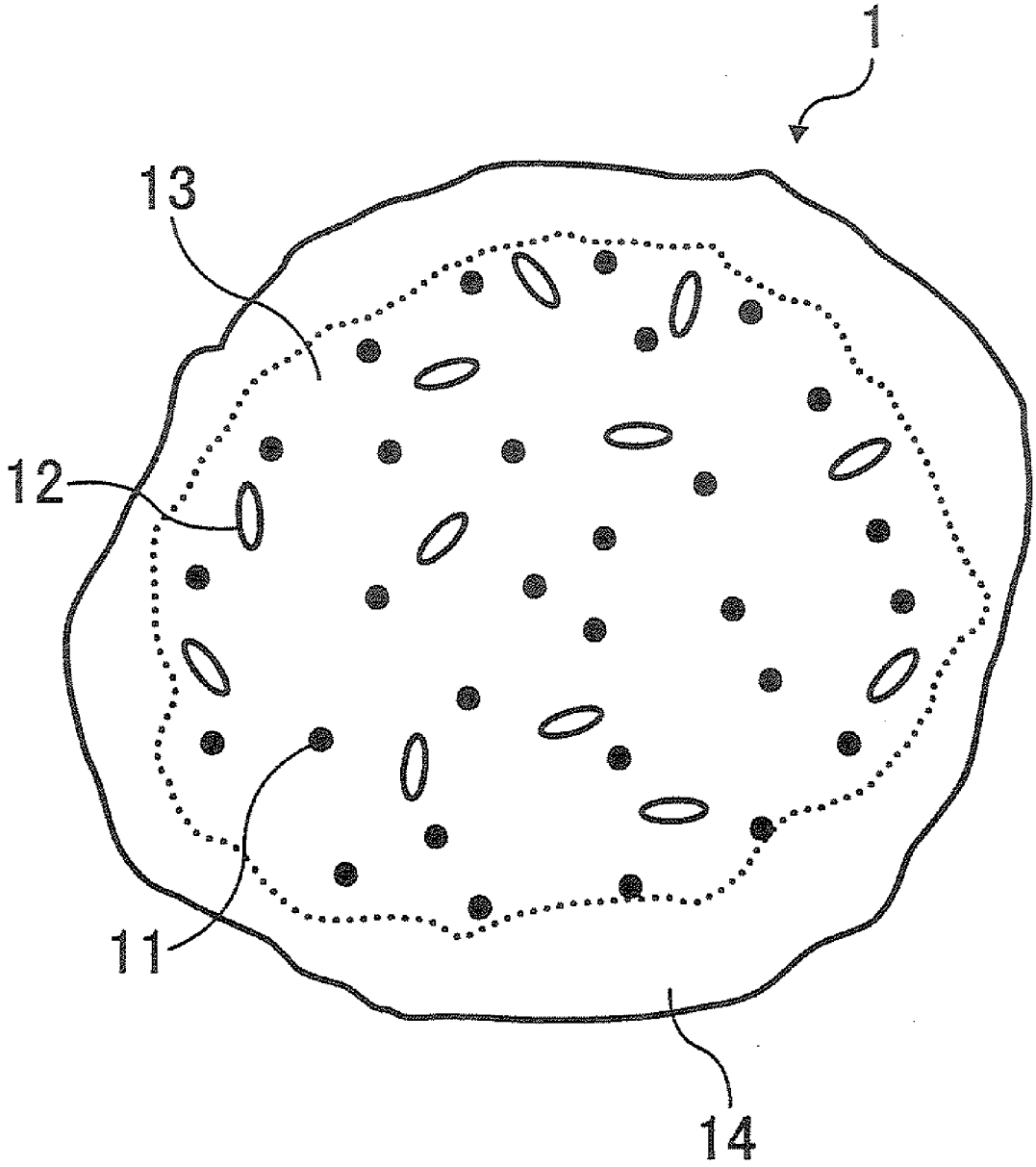
FIG. 1 is a cross-sectional view illustrating an embodiment of the toner of the present invention.

The toner of the present invention is prepared by a wet granulation method, and adsorbs ammonia ($NH_3$) in an amount of from 40 to 700 μmol/$m^2$ and carbon dioxide ($CO_2$) in an amount of not greater than 10 μmol/$m^2$ per unit of specific surface area. When the adsorbed amount of $NH_3$ is too small or the adsorbed amount of $CO_2$ is too large, the toner has too broad a charge quantity distribution, and therefore background fouling tends to occur. This phenomenon notably occurs when a toner includes a large amount of a release agent so as to improve fixing separativeness when used for an oil less fixing device. When the adsorbed amount of $NH_3$ is too large, chargeability of the toner deteriorates. It is possible to decrease the occurrence of background fouling by controlling the surface property of the toner, regardless of the acid value of the toner. The specific surface area can be determined by BET method.

The chemical-adsorbed amounts of ammonia ($NH_3$) and carbon dioxide ($CO_2$) per unit weight of a toner, which is converted into molecular number, can be measured using an instrument such as AUTOSORB-1-C (from Quantachrome Instruments), for example. The measurement conditions are as follows.

Refrigerant temperature: 25° C.

Pretreatment: Vacuum degassing (30° C., 12 hours)

Cell: Flow cell for chemical adsorption

Measuring pressure range: 80-800 mmHg

Measurement mode: Chemical adsorption mode (Gas adsorption method)

Each of the adsorbed amounts of $NH_3$ and $CO_2$ can be determined by applying extrapolation method to 7 points present in a range of from 300 to 800 mmHg of a combined isothermal line, which is one of a chemical adsorption isothermal line.

The toner of the present invention preferably has a volume average particle diameter of from 3 to 8 μm, and more preferably from 4 to 7 μm. When the volume average particle diameter is too small, various problems tend to occur in image forming processes. When the volume average particle diameter is too large, resolution of the resultant image tends to deteriorate.

The toner of the present invention preferably has an average circularity of not less than 0.96. When the average circularity is too small, transferability of the toner deteriorates.

The toner of the present invention comprises a binder resin and a colorant, and preferably comprises a release agent. Further, the toner preferably comprises an external additive to improve fluidity, developability, and chargeability of the toner.

The product of the volume average particle diameter and the content of the external additive is preferably from 3 to 20 μm·% by weight. When this product is too small, transferability of the toner deteriorates, and therefore hollow defects tend to occur in the resultant image. This phenomenon notably occurs in a full-color image forming process and a toner including a release agent. When this product is too large, fixability of the toner deteriorates, and therefore fixing strength of the resultant image decreases. This phenomenon notably occurs in an image forming apparatus including an oil less fixing device.

"Transferability" represents the ease with which a toner formed on the surface of a photoreceptor can be transferred onto a transfer medium. If the toner formed on the surface of a photoreceptor is transferred first onto an intermediate transfer medium and then transferred onto the transfer medium, "transferability" represents the ease with which the toner can be transferred from the photoreceptor onto the intermediate transfer medium, and that from the intermediate transfer medium onto the transfer medium.

As the external additive, particulate inorganic materials are preferably used in the present invention. Specific examples of the particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, combined oxides such as silicon oxide/magnesium oxide and silicon oxide/aluminum oxide, zirconium oxide, barium sulfate, barium carbonate, calcium carbonate, silicon carbide, silicon nitride, etc. These can be used alone or in combination. From the viewpoint of improving fluidity and chargeability of the toner, silica is preferably used.

The above particulate inorganic materials are preferably surface-treated to improve the hydrophobicity thereof. Such a surface-treated inorganic material can prevent deterioration of fluidity and chargeability of the toner even under high humidity conditions. Specific examples of surface treatment agents include, but are not limited to, silane coupling agents, silylation agents, titanate coupling agents, aluminum coupling agents, silicone oils, modified silicone oils, fluorinated silane coupling agents, fluorinated silicone oils, coupling agents having amino group, coupling agents having a quaternary ammonium salt structure, etc.

The particulate inorganic material preferably has a primary particle diameter of from 5 nm to 2 μm, and more preferably from 5 to 500 nm. The particulate inorganic material preferably has a BET specific surface area of from 20 to 500 $m^2/g$.

The toner preferably includes the particulate inorganic material in an amount of from 0.01 to 5.0% by weight, and more preferably from 0.01 to 2.0% by weight, based on total weight of the toner.

Particles of a polymer selected from polystyrenes, polymethacrylates, and polyacrylate copolymers, which are prepared by a polymerization method selected from soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

The toner of the present invention preferably has a core-shell structure. FIG. 1 is a cross-sectional view illustrating an embodiment of the toner having a core-shell structure of the present invention. A toner 1 includes a colorant 11, a release agent 12, a core 13 including a binder resin (A), and a shell 14 including a binder resin (B) which covers the core 13. The binder resin (A) preferably includes a resin having a polyester skeleton (hereinafter referred to as a polyester-based resin), and the binder resin (B) preferably includes a vinyl copolymer resin. The core 13, which forms the main body of the toner, includes a polyester-based resin having an advantage in improving both low-temperature fixability and thermostable preservability of the toner, and the shell, which largely influences the chargeability of the toner, includes a vinyl copolymer resin having an advantage in improving chargeability of the toner.

The adsorbed amount of $NH_3$ per unit of specific surface area of the toner can be controlled by changing the resin composition of the shell and the weight ratio of the shell to the core. Monomers used for preparing a resin forming the shell preferably include an acid monomer in an amount of not less than 5% by weight. In this case, the adsorbed amount of $NH_3$ per unit of specific surface area of the toner is relatively large. The weight ratio of the shell to the core is preferably not less than 0.05. When the weight ratio is too small, the adsorbed amount of $NH_3$ tends to be small.

The adsorbed amount of $CO_2$ per unit of specific surface area of the toner can be controlled by changing the resin composition of the shell. Monomers used for preparing a resin forming the shell preferably include a basic monomer in an amount of not greater than 0.5% by weight, and more preferably 0%. In this case, the adsorbed amount of $CO_2$ per unit of specific surface area of the toner is relatively small.

The reasons why the vinyl copolymer resin has an advantage in controlling chargeability of the toner are as follows:

(1) Plural kinds of monomers can be polymerized. Various kinds of monomers can be used (i.e., Having high flexibility in choosing monomers) For example, polar groups (such as carboxylic acid group and sulfonic acid group) are easily introduced.

(2) A functional group originated from a monomer can be efficiently located at the surface of the resultant toner. For example, the structure of the resultant particulate polymer can be controlled by the polarity of a monomer, in emulsification polymerizations and suspension polymerizations.

For the above reason, the toner has both good fixability (i.e., low-temperature fixability) and chargeability (i.e., developability and transferability).

The weight ratio of the shell to the core is preferably 0.05 to 0.5, more preferably from 0.07 to 0.4, and much more preferably from 0.1 to 0.3. When the weight ratio is too small, the binder resin (B) cannot sufficiently exert its effect. When the weight ratio is too large, the binder resin (A) cannot sufficiently exert its effect.

The toner of the present invention satisfies the following relationships:

$$RA(P)\times 0.5>RB(P) \text{ and } RA(W)\times 0.5>RB(W),$$

preferably satisfies the following relationships:

$$RA(P)\times 0.2>RB(P) \text{ and } RA(W)\times 0.2>RB(W),$$

and much more preferably satisfies the following relationships:

$$RA(P)\times 0.01>RB(P) \text{ and } RA(W)\times 0.01>RB(W),$$

wherein RA(P) represents a weight ratio of the colorant included in the core to the core, RA(W) represents a weight ratio of the release agent included in the core to the core, RB(P) represents a weight ratio of the colorant included in the shell to the shell, and RB (W) represents a weight ratio of the release agent included in the shell to the shell.

Namely, the colorant and the release agent preferably do not exist near the surface of the toner. Such a toner does not cause a formation of release agent film on image forming members such as a photoreceptor. In addition, the toner has stable chargeability and environmental resistance, and therefore the charge difference between four-color toners can be minimized.

As the polyester-based resin, any known polyester-based resins can be used and are not particularly limited. A mixture of plural polyester-based resins can also be used. Specific examples of the polyester-based resin include polycondensation products of a polyol (1) with a polycarboxylic acid (2).

Specific examples of the polyol (1) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A; bisphenol F; bisphenol S; 4,4'-dihydroxybiphenyls (e.g., 3,3'-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (i.e., tetrafluoro bisphenol A), 2,2-bis(3-hydroxyphenyl)-1,1,1,3,3,3-hexafluoropropane); bis(4-hydroxyphenyl)ethers (e.g., bis(3-fluoro-4-hydroxyphenyl)ether)), adducts of the above-mentioned alicyclic diols with an alkylene oxide (e.g., ethylene oxide, propylene oxide and butylenes oxide), adducts of the above mentioned bisphenols with an alkylene oxide (e.g., ethylene oxide, propylene oxide and butylenes oxide), etc.

Among these, alkylene glycols having 2 to 12 carbon atoms and adducts of bisphenols with an alkylene oxide are preferably used, and adducts of bisphenols with an alkylene oxide and mixture thereof with alkylene glycols having 2 to 12 carbon atoms are more preferably used.

Further, multivalent aliphatic alcohols having three or more valences (e.g., glycerin, trimethylolethane, trimethylolpropane, pentaerythritol, sorbitol), phenols having three or more valences (e.g., trisphenol PA, phenol novolac, cresol novolac), and adducts of the above-mentioned phenols having three or more valences with an alkylene oxide can be used.

These polyols can be used alone or in combination.

Specific examples of the polycarboxylic acid (2) include, but are not limited to, alkylene dicarboxylic acids (e.g., succinic acid, adipic acid, sebacic acid), alkenylene dicarboxylic acids (e.g., maleic acid, fumaric acid), aromatic dicarboxylic acids (e.g., phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, hexafluoroisopropylidene diphthalic anhydride), etc.

Among these, alkenylene dicarboxylic acids having 4 to 20 carbon atoms and aromatic dicarboxylic acids having 8 to 20 carbon atoms are preferably used.

Further, as polycarboxylic acids having three or more valences, aromatic polycarboxylic acids having 9 to 20 carbon atoms (e.g., trimellitic acid, pyromellitic acid) and acid anhydrides and lower alkyl ester (e.g., methyl ester, ethyl ester, isopropyl ester) thereof can be used.

These polycarboxylic acids can be used alone or in combination.

A polyol (1) and a polycarboxylic acid (2) are mixed so that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polyester-based resin has a peak molecular weight of from 1,000 to 30,000, preferably from 1,500 to 10,000, and more preferably from 2,000 to 8,000. When the peak molecular weight is too small, thermostable preservability of the toner deteriorates. When the peak molecular weight is too large, low-temperature fixability of the toner deteriorates.

The polyester-based resin has a glass transition temperature of not less than 40° C. When the glass transition temperature is too small, thermostable preservability of the toner deteriorates.

As the vinyl copolymer resin, any known vinyl copolymer resins can be used and are not particularly limited. A mixture of plural vinyl copolymer resins can also be used.

The vinyl copolymer resin is prepared by copolymerizing vinyl monomers. Specific preferred examples of suitable vinyl monomers are shown as follows.

(1) Vinyl hydrocarbons:

aliphatic vinyl hydrocarbons such as alkenes (e.g., ethylene, propylene, butene, isobutylene, pentene, heptene, diisobutylene, octene, dodecene, octadecene, other α-olefins except the above-mentioned compounds) and alkadienes (e.g., butadiene, isoprene, 1,4-pentadiene, 1,6-hexadiene, 1,7-octadiene);

alicyclic vinyl hydrocarbons such as cycloalkenes and cycloalkadienes (e.g., cyclohexene, (di)cyclopentadiene, vinylcyclohexene, ethylidenebicycloheptene); and terpenes (e.g., pinene, limonene, indene); and aromatic vinyl hydrocarbons such as styrene and hydrocarbon (alkyl, cycloalkyl, aralkyl and/or alkenyl) derivatives thereof (e.g., α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene), and vinylnaphthalene;

(2) Vinyl monomers including carboxyl group and salts thereof:

unsaturated monocarboxylic or dicarboxylic acids having 3 to 30 carbon atoms and anhydrides and monoalkyl (1 to 24 carbon atoms) esters thereof (e.g., (meth)acrylic acid, maleic acid, maleic anhydride, monoalkyl maleate, fumaric acid, monoalkyl fumarate, crotonic acid, itaconic acid, monoalkyl itaconate, itaconic glycol monoether, citraconic acid, monoalkyl citraconate, cinnamic acid); and salts thereof;

(3) Vinyl monomers including sulfonic group and vinyl monoesters of sulfuric acid, and salts thereof:

alkene sulfonic acids having 2 to 14 carbon atoms (e.g., vinyl sulfonic acid, (meth)allyl sulfonic acid, methyl vinyl sulfonic acid, styrene sulfonic acid), and alkyl derivatives thereof having 2 to 24 carbon atoms (e.g., α-methylstyrene sulfonic acid); sulfo(hydroxy)alkyl(meth)acrylates or (meth)acrylamides (e.g., sulfopropyl(meth)acrylate, 2-hydroxy-3-(meth) acryloxypropyl sulfonic acid, 2-(meth)acryloylamino-2,2-dimethylethane sulfonic acid, 2-(meth)acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, alkyl (3 to 18 carbon atoms) allylsulfo succinic acid, sulfuric acid ester of poly(n is 2 to 30)oxyalkylene (ethylene, propylene, butylene and mono, random and block copolymers thereof) mono(meth)acrylate such as sulfuric acid ester of poly(n is 5 to 15)oxypropylene monomethacrylate, sulfuric acid esters of polyoxyethylene polycyclic phenylether); and salts thereof;

(4) Vinyl monomers including phosphate group and salts thereof:

(meth)acryloyloxyalkyl phosphoric acid monoesters (e.g., 2-hydroxyethyl(meth)acryloyl phosphate, phenyl-2-acryloyloxyethyl phosphate);

(meth)acryloyloxyalkyl(1 to 24 carbon atoms) phosphonic acids (e.g., 2-acryloyloxyethyl phosphonic acid); and salts thereof.

Specific examples of the above-mentioned salts of monomers shown in the above paragraphs (2) to (4) include alkali metal salts (e.g., sodium salts, potassium salts), alkaline-earth metal salts (e.g., calcium salts, magnesium salts), ammonium salts, amine salts and quaternary ammonium salts.

(5) Vinyl monomers including hydroxyl group:

hydroxystyrene, N-methylol (meth)acrylamide, hydroxyethyl (meth)acrylate, hydroxypropyl(meth)acrylate, polyethyleneglycol mono(meth)acrylate, (meth)allylalcohol, crotyl alcohol, isocrotyl alcohol, 1-butene-3-ol, 2-butene-1-ol, 2-butene-1,4-diol, propargyl alcohol, 2-hydroxyethyl propenyl ether, and sucrose allyl ether;

(6) Vinyl monomers including nitrogen:

vinyl monomers including amino group (e.g., aminoethyl (meth)acrylate, dimethylaminoethyl(meth)acrylate, diethylaminoethyl(meth)acrylate, t-butylaminoethyl (meth)acrylate, N-aminoethyl(meth)acrylamide, (meth)acrylamine, morpholinoethyl(meth)acrylate, 4-vinylpyridine, 2-vinylpyridine, crotylamine, N,N-dimethylaminostyrene, methyl-α-acetoamino acrylate, vinylimidazole, N-vinylpyrrol, N-vinylthiopyrrolidone, N-arylphenylenediamine, aminocarbazole, aminothiazole, aminoindole, aminopyrrol, aminoimidazole, aminomercaptothiazole, and salts thereof);

vinyl monomers including amide group (e.g., (meth)acrylamide, N-methyl(meth)acrylamide, N-butylacrylamide, diacetoneacrylamide, N-methylol(meth)acrylamide, N,N-methylene-bis(meth)acrylamide, cinammic acid amide, N,N-dimethylacrylamide, N,N-dibenzylacrylamide, methacrylformamide, N-methyl-N-vinylacetamide, N-vinylpyrrolidone);

vinyl monomers including nitrile group (e.g., (meth)acrylonitrile, cyanostyrene, cyanoacrylate);

vinyl monomers including quaternary ammonium cation group such as quaternary compounds of vinyl monomers (e.g., dimethylaminoethyl(meth)acrylate, diethylaminoethyl (meth)acrylate, dimethylaminoethyl(meth)acrylamide, diethylaminoethyl(meth)acrylamide, diallylamine) including tertiary amine group produced by using quaternate agent (e.g., methyl chloride, dimethyl sulfonic acid, benzyl chloride, dimethyl carbonate); and vinyl monomers including nitro group (e.g., Nitrostyrene);

(7) Vinyl monomers including epoxy group:

Glycidyl(meth)acrylate, tetrahydrofurfuryl(meth)acrylate, p-vinylphenylphenyloxide;

(8) Vinylesters, vinyl(thio)ethers, vinylketones, vinylsulfones:

vinylesters (e.g., vinyl acetate, vinyl butyrate, vinyl propionate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinylmethoxy acetate, vinyl benzoate, ethyl-α-ethoxyacrylate, alkyl(meth)acrylates including alkyl group having 1 to 50 carbon atoms (such as methyl(meth)acrylate, ethyl(meth) acrylate, propyl(meth)acrylate, butyl (meth)acrylate, 2-ethylhexyl(meth)acrylate, dodecyl (meth)acrylate, hexadecyl (meth)acrylate, heptadecyl (meth)acrylate, and eicocyl (meth)acrylate), dialkyl fumarates (2 alkyl groups have 2 to 8 carbon atoms and have straight-chain, branched-chain or alicyclic structure), dialkyl maleates (2 alkyl groups have 2 to 8 carbon atoms and have straight-chain, branched-chain or alicyclic structure), poly(meth)allyloxyalkanes (such as diallyloxyethane, triallyloxyethane, tetraallyloxyethane, tetraallyloxypropane, tetraallyloxybutane, and tetramethallyloxyethane), vinyl monomers including polyalkyleneglycol chain (such as polyethyleneglycol (molecular weight of 300) mono(meth)acrylate, polypropyleneglycol (molecular weight of 500) monoacrylate, adduct of methy alcohol (meth)acrylate with 10 mols of ethyleneoxide, and adduct of lauryl alcohol (meth)acrylate with 30 mols of ethyleneoxide), and poly(meth)acrylates ((meth)acrylates of polyalcohols such as ethyleneglycol di(meth)acrylate, propyleneglycol di(meth)acrylate, neopentylglycol di(meth)acrylate, trimethylolpropane tri(meth)acrylate, and polyethyleneglycol di(meth)acrylate)); vinyl(thio)ethers (e.g., vinylmethylether, vinylethylether, vinylpropylether, vinylbutylether, vinyl-2-ethylhexylether, vinylphenylether, vinyl-2-methoxyethylether, methoxybutadiene, vinyl-2-butoxyethylether, 3,4-dihydro-1,2-pyran, 2-butoxy-2'-vinyloxydiethylether, vinyl-2-ethylmercaptoethylether, acetoxystyrene, phenoxystyrene);

vinylketones (e.g., vinyl methyl ketone, vinyl ethyl ketone, vinyl phenyl ketone); and vinylsulfones (e.g., divinylsulfide, p-vinyldiphenylsulfide, vinylethylsulfide, vinylethylsulufone, divinylsulfone, divinylsulfoxide);

(9) Another vinyl monomers:

isocyanatoethyl(meth)acrylate, and m-isopropenyl-α,α-dimethylbenzylisocyanate.

(10) Vinyl monomers including fluorine:

4-fluorostyrene, 2,3,5,6-tetrafluorostyrene, pentafluorophenyl(meth)acrylate, pentafluorobenzyl (meth)acrylate, perfluorohexyl(meth)acrylate, perfluorocyclohexylmethyl (meth)acrylate, 2,2,2-trifluoroethyl(meth)acrylate, 2,2,3,3-tetrafluoropropyl(meth)acrylate, 1H,1H,4H-hexafluorobutyl (meth)acrylate, 1H,1H,5H-octafluoropentyl(meta)acrylate, 1H,1H,7H-dodecafluoroheptyl(meth)acrylate, perfluorooctyl (meth)acrylate, 2-perfluorooctylethyl(meth)acrylate, heptadecafuluorodecyl(meth)acrylate, trihydroperfluoroundecyl (meth)acrylate, perfluoronorbornylmethyl(meth)acrylate, 1H-perfluoroisobornyl(meth)acrylate, 2-(N-butylperfluorooctanesulfoneamide)ethyl(meth)acrylate, 2-(N-ethylperfluorooctanesulfoneamide)ethyl(meth)acrylate, derivatives of α-fluoroacrylic acid;

bis-hexafluoroisopropyl itaconate, bis-hexafluoroisopropyl maleate, bis-perfluorooctyl itaconate, bis-perfluorooctyl maleate, bis-trifluoroethyl itaconate, bis-trifluoroethyl maleate;

vinylheptafluoro butyrate, vinylperfluoro heptanoate, vinylperfluoro nonanoate, vinylperfluoro octanoate, etc.

Specific examples of the vinyl copolymer resin include copolymers of two or more vinyl monomers shown in the above paragraphs (1) to (10) at any mixing ratio such as styrene-(meth) acrylate copolymer, styrene-butadiene copolymer, (meth) acrylic acid-acrylate copolymer, styrene-acrylonitrile copolymer, styrene-maleic anhydride copolymer, styrene-(meth)acrylic acid copolymer, styrene-(meth) acrylic acid-divinylbenzene copolymer, and styrene-styrene sulfonic acid-(meth)acrylate copolymer.

When the toner is prepared, an aqueous dispersion of the vinyl copolymer resin is preferably used. Such a dispersion can be prepared by typical emulsion polymerization, etc.

The binder resin (B) is preferably formed by aggregating and/or fusing particles of vinyl copolymer resin. When the shell is formed of aggregated particles of the vinyl copolymer resin, the core is completely covered therewith. When the shell is formed of fused particles of the vinyl copolymer resin, the core is much more completely covered therewith. As a result, the resultant toner has a smooth and even surface, and therefore the toner has stable charge quantity distribution and good transferability.

The polyester-based resin may include a modified polyester resin (C) having a urethane and/or urea bond so as to control viscosity of the toner for the purpose of improving offset resistance. The binder resin (A) preferably includes the modified polyester resin (C) having a urethane and/or urea bond in an amount of not larger than 20% by weight, more preferably not larger than 15% by weight, and much more preferably not larger than 10% by weight. When the amount is too large, low-temperature fixability of the toner deteriorates. The modified polyester resin (C) having a urethane and/or urea bond can be directly mixed with the binder resin (A). However, in terms of manufacturability, the modified polyester resin is preferably prepared by mixing and reacting (i.e., elongating and/or cross-linking) a prepolymer (D) having an isocyanate group at its end with an amine (E) capable of reacting with the prepolymer (D) so that the modified polyester resin (C) having a urethane and/or urea bond is prepared when or after the toner is granulated. In this case, the modified polyester resin (C) can be easily included in the core region.

The prepolymer having an isocyanate group (D) is formed by a reaction between a polyisocyanate (3) and a polyester having an active hydrogen group which is formed by the polycondensation reaction between the polyol (1) and the polycarboxylic acid (2). Specific examples of the active hydrogen group included in the polyester include, but are not limited to, hydroxyl group (alcoholic hydroxyl group and phenolic hydroxyl group), amino group, carboxyl group, mercapto group, etc. Among these, alcoholic hydroxyl group is preferably selected.

Specific examples of the polyisocyanate (3) include, but are not limited to, aliphatic polyisocyanates (e.g., tetramethylenediisocyanate, hexamethylenediisocyanate, 2,6-diisocyanatemethylcaproate); alicyclic polyisocyanates (e.g., isophorondiisocyanate, cyclohexylmethanediisocyanate); aromatic diisocyanates (e.g., tolylenediisocyanate, diphenylmethanediisocyanate); aromatic aliphatic diisocyanates (α,α,α',α',-tetramethylxylylenediisocyanate); isocyanurates; the above-mentioned polyisocyanates blocked with phenol derivatives, oxime and caprolactam; and their combinations. These can be used alone or in combination.

A polyisocyanate (3) is mixed with a polyester such that the equivalent ratio ([NCO]/[OH]) between an isocyanate group [NCO] and a hydroxyl group [OH] included in the polyester is typically from 5/1 to 1/1, preferably from 4/1 to 1.2/1, and more preferably from 2.5/1 to 1.5/1. When the ratio [NCO]/[OH] is too large, low-temperature fixability of the resultant toner deteriorates. When the ratio [NCO]/[OH] is too small, the urea content in the resultant modified polyester resin (C) decreases and hot offset resistance of the resultant toner deteriorates.

The content of the constitutional unit obtained from a polyisocyanate (3) in the prepolymer (D) is from 0.5 to 40% by weight, preferably from 1 to 30% by weight, and more preferably from 2 to 20% by weight. When the content is too small, hot offset resistance of the resultant toner deteriorates. In contrast, when the content is too large, low-temperature fixability of the resultant toner deteriorates.

The number of the isocyanate groups included in a molecule of the polyester prepolymer is at least 1, preferably from 1.5 to 3 on average, and more preferably from 1.8 to 2.5 on average. When the number of isocyanate groups is less than 1 per molecule, the molecular weight of the modified polyester after an elongation and/or a crosslinking reaction decreases and the hot offset resistance of the resultant toner deteriorates.

Specific examples of the amines (E) include, but are not limited to, diamines (E1), polyamines (E2) having three or more amino groups, amino alcohols (E3), amino mercaptans (E4), amino acids (E5), and blocked amines (E6) in which the amino groups in the amines (E1) to (E5) are blocked.

Specific examples of the diamines (E1) include, but are not limited to, aromatic diamines (e.g., phenylene diamine, diethyltoluene diamine, 4,4'-diaminodiphenyl methane, tetrafluoro-p-xylylene diamine, tetrafluoro-p-phenylene diamine), alicyclic diamines (e.g., 4,4'-diamino-3,3'-dimethyldicyclohexyl methane, diaminocyclohexane isophorondiamine), aliphatic diamines (e.g., ethylene diamine, tetramethylene diamine, hexamethylene diamine, dodecafluorohexylene diamine, tetracosafluorododecylene diamine), etc.

Specific examples of the polyamines (E2) having three or more amino groups include, but are not limited to, diethylene triamine, and triethylene tetramine.

Specific examples of the amino alcohols (E3) include, but are not limited to, ethanol amine, hydroxyethyl aniline, etc.

Specific examples of the amino mercaptan (E4) include, but are not limited to, aminoethyl mercaptan, aminopropyl mercaptan, etc.

Specific examples of the amino acids (E5) include, but are not limited to, amino propionic acid, amino caproic acid, etc.

Specific examples of the blocked amines (E6) include, but are not limited to, ketimine compounds which are prepared by reacting one of the above-mentioned amines (E1) to (E5) with a ketone (e.g., acetone, methyl ethyl ketone, methyl isobutyl ketone), oxazoline compounds, etc.

The molecular weight of the modified polyester resin (C) can optionally be controlled using a reaction stopping agent which stop an elongation and/or cross-linking reaction, if desired. Specific examples of the reaction stopping agent include, but are not limited to, monoamines (e.g., diethyl amine, dibutyl amine, butyl amine, lauryl amine), blocked amines (i.e., ketimine compounds prepared by blocking the monoamines mentioned above), etc.

The mixing ratio (i.e., a ratio [NCO]/[NHx]) of the content of the prepolymer (D) having an isocyanate group to the amine (E) is from 1/2 to 2/1, preferably from 1/1.5 to 1.5/1, and more preferably from 1/1.2 to 1.2/1. When the mixing ratio is too large or too small, the molecular weight of the modified polyester resin (C) decreases, resulting in deterioration of hot offset resistance of the resultant toner.

(Colorant)

Specific examples of the colorants for use in the toner of the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The colorant for use in the present invention can be combined with a resin to be used as a master batch. Specific examples of the resin for use in the master batch include, but are not limited to, the above-mentioned polyester-based resins, styrene polymers and substituted styrene polymers (e.g., polystyrenes, poly-p-chlorostyrenes, polyvinyltoluenes), styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers), polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

(Release Agent)

Any known release agents can be used for the toner of the present invention. Specific examples of the release agents include, but are not limited to, polyolefin waxes (e.g., polyethylene waxes, polypropylene waxes), hydrocarbons having along chain (e.g., paraffin waxes, SASOL waxes), and waxes having a carbonyl group. Specific examples of the waxes having a carbonyl group include, but are not limited to, esters of polyalkanoic acids (e.g., carnauba waxes, montan waxes, trimethylolpropane tribehenate, pentaerythritol tetrabehenate, pentaerythritol diacetate dibehenate, glycerin tribehenate, 1,18-octadecanediol distearate); polyalkanol esters (e.g., tristearyl trimellitate, distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkanoic acid esters are preferably used.

The toner preferably includes the release agent in an amount of from 3 to 30% by weight, and more preferably from 5 to 15% by weight. When the amount is too small, the wax cannot sufficiently exert its effect, and therefore hot offset easily occurs. When the amount is too large, the wax, which melts at low temperatures, tends to exude from the toner due to the application of thermal and mechanical energies to the toner when agitated in a developing device, and contaminate a toner layer controlling member and a photoreceptor, etc., resulting in causing noise in the resultant image.

When the wax is subjected to a temperature rising scan of a differential scanning calorimeter (DSC), an endothermic peak is preferably observed in a temperature range of from 65 to 115° C. When the temperature is too small, fluidity of the toner deteriorate. When the temperature is too large, fixability of the toner deteriorates.

(Charge Controlling Agent)

The toner of the present invention may optionally include a charge controlling agent.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEGVP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

(Cleanability Improving Agent)

A cleanability improving agent can be added to the toner so as to remove toner particles remaining on the surface of a photoreceptor or a primary transfer medium after a toner image is transferred. Specific examples of the cleanability improving agents include, but are not limited to, fatty acids and metal salts thereof such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 to 1 μm are preferably used as the cleanability improving agent.

(Method of Preparing Toner)

Next, the method of preparing the toner of the present invention will be explained. The toner is preferably prepared by the following method, but is not limited thereto.

The toner of the present invention is preferably prepared by a method comprising:

dissolving or dispersing core constituents comprising a polyester-based resin and/or a prepolymer thereof, a colorant, and a release agent in an organic solvent to prepare a core constituent mixture liquid;

dispersing the core constituent mixture liquid in an aqueous medium to prepare a first dispersion containing core particles; and adding a second dispersion containing a particulate vinyl copolymer resin to the first dispersion to adhere the particulate vinyl copolymer resin to the core particles.

The organic solvent used for dissolving or dispersing core constituents preferably has a Hansen solubility parameter (described in POLYMER HANDBOOK 4$^{th}$ Edition, WILEY-INTERSCIENCE Volume 2, Section VII) of not greater than 19.5. In addition, volatile solvents having a boiling point of lower than 100° C. are preferably used so as to be easily removed after the granulating process.

Specific examples of the volatile solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. In particular, ester solvents such as methyl acetate and ethyl acetate, aromatic solvents such as toluene and xylene, and halogenated hydrocarbons such as methylene chloride, 1,2-dichloroethane, chloroform and carbon tetrachloride are preferably used. Each of the toner constituents can be dissolved or dispersed simultaneously, however, these are dissolved or dispersed respectively in general. The solvent used in the respective dissolution or dispersion liquid can be same or different, but it is preferable to use the same solvent in each dissolution or dispersion liquid so as to be easily removed.

The dissolution or dispersion liquid of the polyester-based resin preferably has a resin content of from 40 to 80%. When the resin content is too high, dissolution or dispersion cannot be well performed because of high viscosity of the liquid. When the resin content is too low, manufacturability of the toner deteriorates.

When the dissolution or dispersion liquid of the prepolymer of the polyester-based resin is prepared, the prepolymer can be dissolved or dispersed together with the polyester-based resin in the same liquid, or separately in the different liquids. However, it is preferable that the prepolymer and the polyester-based resin are dissolved or dispersed separately in the different liquids because solubility and viscosity of each material is different.

The colorant can be dissolved or dispersed in the solvent alone, or with the polyester-based resin or the prepolymer, optionally with a dispersibility improving agent and another polyester resin. In addition, the master batch of the colorant mentioned above can be used.

When an organic solvent in which the release agent is not dissolved is used, a dispersion of the release agent can be prepared by typical methods. Namely, the mixture of the organic solvent and the release agent is subjected to a dispersion treatment using a bead mill. In this case, it is preferable that the mixture is once heated to the melting point of the release agent followed by cooling with agitation, before being subjected to the dispersion treatment using a bead mill. This is because the dispersion time can be shortened. The release agent can be used alone or in combination, and optionally mixed with a dispersibility improving agent and another polyester resin.

Suitable aqueous media used for preparing core particles include water. In addition, other solvents which can be mixed with water can be added to water. Further, the above-mentioned solvents having a Hansen solubility parameter of not greater than 19.5 can also be added to water. In this case, the emulsification or dispersion can be stabilized.

Specific examples of such solvents include alcohols (e.g., methanol, isopropanol, ethylene glycol), dimethylformamide, tetrahydrofuran, cellosolves (e.g., methyl cellosolve), lower ketones (e.g., acetone, methyl ethyl ketone), etc.

The content of the aqueous medium to 100 parts by weight of the toner constituent mixture liquid is typically from 50 to 2,000 parts by weight, and preferably from 100 to 1,000 parts by weight. When the content is too small, the toner constituents tend not to be well dispersed, and thereby a toner having a desired particle diameter cannot be prepared. In contrast, when the content is too large, the production costs increase.

The aqueous medium preferably includes a dispersion stabilizer such as an inorganic dispersant and a particulate resin. In this case, the resultant particles have a sharp particle diameter distribution and good dispersion stability.

Specific examples of the inorganic dispersants include, but are not limited to, tricalcium phosphate, calcium carbonate, titanium oxide, colloidal silica, hydroxyapatite, etc.

Any resins capable of forming an aqueous dispersion thereof can be used for the particulate resin, whether the resin is thermoplastic resin or thermosetting resin. Specific examples of resins used for the particulate resins include, but are not limited to, vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These resins can be used alone or in combination. Among these resins, vinyl resins, polyurethane resins, epoxy resins, and polyester resins are preferably used because these resins can easily form aqueous dispersions of the particulate resins thereof.

Suitable methods for forming an aqueous dispersion of the particulate resin are as follows, but are not limited thereto:

(a) When the resin is a vinyl resin, an aqueous dispersion of a particulate resin is directly formed by polymerization reaction (such as suspension polymerization, emulsion polymerization, seed polymerization, and dispersion polymerization) of monomers in an aqueous medium.

(b) When the resin is a polyaddition resin or a polycondensation resin such as polyester resin, polyurethane resin, and epoxy resin, a precursor of the resin (such as monomer and oligomer) or a solvent solution of the precursor is dispersed in an aqueous medium in the presence of a suitable dispersing agent, followed by heating or adding a curing agent so that an aqueous dispersion of a particulate resin is formed.

(c) When the resin is a polyaddition resin or a polycondensation resin such as polyester resin, polyurethane resin, and epoxy resin, a precursor of the resin (such as monomer and oligomer, preferably in liquid form, if not liquid, preferably liquefied by the application of heat) or a solvent solution of the precursor is phase-inversion emulsified by adding an aqueous medium after adding a suitable emulsifying agent thereto so that an aqueous dispersion of a particulate resin is formed.

(d) A resin formed by polymerization reaction (such as addition polymerization, ring-opening polymerization, condensation polymerization, and addition condensation) is pulverized using a mechanical rotational type pulverizer or a jet type pulverizer, followed by classification, to prepare a particulate resin. The particulate resin is dispersed in an aqueous medium in the presence of a suitable dispersing agent so that an aqueous dispersion of the particulate resin is formed.

(e) A resin formed by polymerization reaction (such as addition polymerization, ring-opening polymerization, condensation polymerization, and addition condensation) is dissolved in a solvent, and then the resin solution is sprayed in the air to prepare a particulate resin. The particulate resin is dispersed in an aqueous medium in the presence of a suitable dispersing agent so that an aqueous dispersion of the particulate resin is formed.

(f) A resin formed by polymerization reaction (such as addition polymerization, ring-opening polymerization, condensation polymerization, and addition condensation) is dissolved in a solvent to prepare a resin solution. Another solvent is added to the resin solution or the resin solution is subjected to cooling after heating, and then the solvent is removed so that a particulate resin separates out. The particulate resin is dispersed in an aqueous medium in the presence of a suitable dispersing agent so that an aqueous dispersion of the particulate resin is formed.

(g) A resin formed by polymerization reaction (such as addition polymerization, ring-opening polymerization, condensation polymerization, and addition condensation) is dissolved in a solvent, and then the resin solution is dispersed in an aqueous medium in the presence of a suitable dispersing agent, followed by removal of the solvent, so that an aqueous dispersion of a particulate resin is formed.

(h) A resin formed by polymerization reaction (such as addition polymerization, ring-opening polymerization, condensation polymerization, and addition condensation) is dissolved in a solvent, and then the resin solution is phase-inversion emulsified by adding an aqueous medium after adding a suitable emulsifying agent thereto so that an aqueous dispersion of a particulate resin is formed.

When the toner constituent mixture liquid is emulsified and dispersed in an aqueous medium, surfactants are preferably used.

Specific examples of the surfactants include, but are not limited to, anionic surfactants such as alkylbenzene sulfonic acid salts, α-olefin sulfonic acid salts and phosphoric acid salts; cationic surfactants such as amine salts (e.g., alkyl amine salts, aminoalcohol fatty acid derivatives, polyamine fatty acid derivatives, imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts, benzethonium chloride); nonionic surfactants such as fatty acid amine derivatives and polyhydric alcohol derivatives; and ampholytic surfactants such as aniline, dodecyldi(aminoethyl)glycin, di(octylaminoethyl)glycin, and N-alkyl-N,N-dimethylammonium betaine.

By using a fluorine-containing surfactant as the surfactant, good charging properties and good charge rising property can be imparted to the resultant toner. Specific examples of anionic surfactants having a fluoroalkyl group include, but are not limited to, fluoroalkyl carboxylic acids having from 2 to 10 carbon atoms and metal salts thereof, disodium perfluorooctanesulfonylglutamate, sodium 3-{ω-fluoroalkyl(C6-C11)oxy}-1-alkyl(C3-C4) sulfonate, sodium 3-{ω-fluoroalkanoyl (C6-C8)-N-ethylamino}-1-propanesulfonate, fluoroalkyl (C11-C20) carboxylic acids and metal salts thereof, perfluoroalkyl (C7-C13) carboxylic acids and metal salts thereof, perfluoroalkyl (C4-C12) sulfonate and metal salts thereof, perfluorooctanesulfonic acid diethanol amides, N-propyl-N-(2-hydroxyethyl)perfluorooctanesulfone amide, perfluoroalkyl (C6-C10)sulfoneamidepropyltrimethyl ammonium salts, salts of perfluoroalkyl (C6-C10)-N-ethylsulfonyl glycin, monoperfluoroalkyl (C6-C16)ethylphosphates, etc. Specific examples of the cationic surfactants having a fluoroalkyl group include, but are not limited to, primary, secondary, and tertiary aliphatic amines having a fluoroalkyl group, aliphatic quaternary salts such as perfluoroalkyl (C6-C10)sulfoneamidepropyltrimethylammonium salts, benzalkonium salts, benzetonium chloride, pyridinium salts, imidazolinium salts, etc.

Further, it is possible to stably disperse the toner constituent mixture liquid in an aqueous liquid using a polymeric protection colloid. Specific examples of such protection colloids include, but are not limited to, polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γhydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, N-methylolmethacrylamide), vinyl alcohols and ethers thereof (e.g., vinyl methyl ether, vinyl ethyl ether, vinyl propyl ether), esters of vinyl alcohols with a compound having a carboxyl group (e.g., vinyl acetate, vinyl propionate, vinyl butyrate); acrylic amides (e.g., acrylamide, methacrylamide, diacetoneacrylamide) and methylol compounds thereof, acid chlorides (e.g., acrylic acid chloride, methacrylic acid chloride), and monomers having a nitrogen atom or an alicyclic ring having a nitrogen atom (e.g. vinyl pyridine, vinyl pyrrolidone, vinyl imidazole, ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, polyoxyethylene nonylphenyl esters); and cellulose compounds such as methyl cellulose, hydroxyethyl cellulose and hydroxypropyl cellulose, can also be used as the polymeric protective colloid.

When a dispersant such as calcium phosphate which can be dissolved in an acid or an alkali is used, the particles are preferably washed by a method in which the particles are washed with an acid such as hydrochloric acid to dissolve the dispersant, and then washed with water. In addition, such dispersants can also be removed from the resultant particles by a method using an enzyme. The dispersants can remain on the surface of the particles, however, it is preferable to remove them so that the resultant toner has a good chargeability.

As the dispersing machine, known mixers and dispersing machines such as low shearing force type dispersing machines, high shearing force type dispersing machines, friction type dispersing machines, high-pressure jet type dispersing machines, and ultrasonic dispersing machine can be used. In order to prepare a dispersion including particles having an average particle diameter of from 2 to 20 μm, high shearing force type dispersing machines are preferably used. When high shearing force type dispersing machines are used, the rotation speed of rotors is not particularly limited, but the rotation speed is generally from 1,000 to 30,000 rpm and preferably from 5,000 to 20,000 rpm. The temperature in the dispersing process is generally 0 to 150° C. (under pressure), and preferably from 20 to 80° C.

In order to remove the organic solvent from the thus prepared emulsion, any known removing methods can be used. For example, a method in which the emulsion is gradually heated under normal pressure or reduced pressure to completely evaporate the organic solvent in the drops of the oil phase can be used.

Next, the process in which a particulate vinyl copolymer resin is adhered to core particles including toner constituents (hereinafter referred to the adherence process) will be explained The particulate vinyl copolymer resin is preferably used as an aqueous dispersion thereof. The aqueous dispersion of the particulate vinyl copolymer resin can be easily prepared by typical emulsion polymerization methods and the resultant dispersion can be used for the adherence process without any treatment. The aqueous dispersion of the particulate vinyl copolymer resin can optionally include a surfactant in order to stably disperse the core particles and the particulate vinyl copolymer resin. The aqueous dispersion of the particulate vinyl copolymer resin is preferably added to the dispersion of the core particles after the organic solvent is removed therefrom.

In the adherence process, the pH of the dispersion can be controlled by adding sodium hydride or hydrochloric acid, in order to efficiently adhere the particulate resin to the core particles.

As an aggregation agent, metal salts comprising metals having 1 to 3 valences can be used. Specific examples of the monovalent metals include, but are not limited to, lithium, potassium, sodium, etc. Specific examples of the divalent metals include, but are not limited to, calcium, magnesium, etc. Specific examples of the trivalent metals include, but are not limited to, aluminum, etc. Specific examples of anionic ions comprised in the salts include, but are not limited to, chloride ion, bromide ion, iodide ion, carbonate ion, sulfate ion, etc. The adherence can be accelerated by the application of heat. The heating temperature can be either above or below the glass transition temperature (Tg) of the particulate vinyl copolymer resin. However, when the adherence process is performed at a temperature around or below the Tg, there may be cases where the particulate vinyl copolymer resin does not well aggregate and/or fuse. Therefore, in this case, the adherence process may preferably be performed again at higher temperature in order to accelerate aggregation and fusion of the particle vinyl copolymer resin so that the particulate vinyl copolymer resin sufficiently covers the core particles and the surface of the shell is uniformized. However, the uniformity of the surface and the circularity of the toner particles are controlled by controlling the heating temperature and the heating time.

In order that the resultant toner may include the modified polyester resin (C) having a urethane and/or a urea group, the prepolymer (D) having an isocyanate group at its ends is mixed with an amine (E) capable of reacting with the prepolymer (D). In this case, the amine (E) can be mixed with the prepolymer (D) in the oil phase liquid before the toner constituent mixture is dispersed in an aqueous medium, or the amine (E) can be directly added to the aqueous medium. The reaction time is determined depending on the reactivity of the isocyanate of the prepolymer (D) used with the amine (E) used. However, the reaction time is typically from 1 minute to 40 hours, and preferably from 1 to 24 hours. The reaction temperature is typically from 0 to 150° C. and preferably from 20 to 98° C. The reaction can be performed before the adherence process, or with the adherence process simultaneously. Of course, the reaction can be performed after the adherence process. In addition, known catalysts can be added, if desired, when the reaction is performed.

The toner particles dispersed in an aqueous medium are washed and dried by any known methods. In particular, the toner particles and the aqueous medium are separated by a centrifugal separator or a filter press (i.e., solid-liquid separation) so that the toner cake is prepared. Then the toner cake is re-dispersed in ion-exchanged water at a temperature of from room temperature to 40° C., following by pH control using acids and bases, if desired. The solid-liquid separation is repeated several times to remove impurities and surfactants. After the washing treatment, the toner particles are subjected to a drying treatment using a flash dryer, a circulating dryer, a vacuum dryer, a vibrating fluid dryer, etc. The toner particles having a small particle diameter can be removed by a centrifugal separation in the liquid, or the toner particles can be subjected to a classification treatment using known classifier after the drying treatment.

The thus prepared toner particles are then mixed with one or more other particulate materials such as charge controlling agents, fluidizers optionally upon application of mechanical impact thereto to fix the particulate materials on the toner particles. Specific examples of such mechanical impact application methods include methods in which a mixture is mixed with a highly rotated blade and methods in which a mixture is put into an air jet to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

(Process Cartridge)

The process cartridge of the present invention comprises a photoreceptor and any one member selected from a charger, a developing device, and a cleaning device, and is detachably attachable to an image forming apparatus such as copiers and printers. The developing device uses the toner of the present invention.

Figure 2:
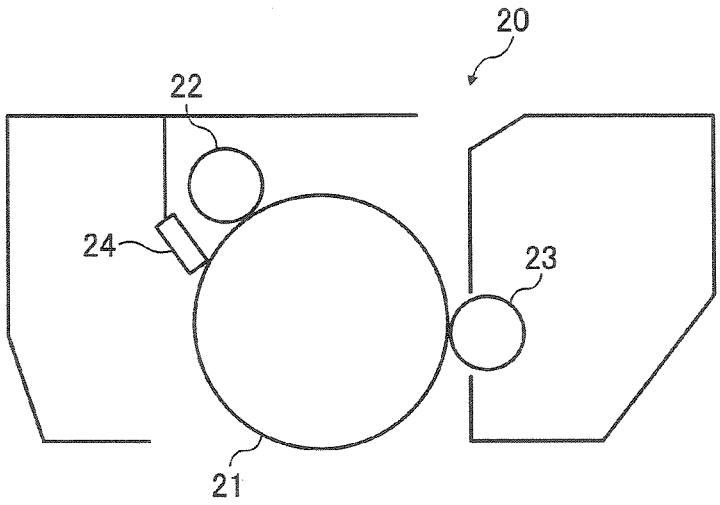
FIG. 2 is a schematic view illustrating an embodiment of the process cartridge of the present invention.

FIG. 2 is a schematic view illustrating an embodiment of the process cartridge of the present invention. A process cartridge 20 includes a photoreceptor 21, a charger 22, a developing device 23, and a cleaning device 24.

Next, an image forming method of an image forming apparatus including the process cartridge 20 will be explained. The photoreceptor 21 rotates at a predetermined speed, and the surface thereof is charged by the charger 22 to reach to a positive or negative predetermined potential while rotating. The photoreceptor 21 is irradiated with a light containing image information emitted by a light irradiator such as a slit irradiator, a laser beam scanning irradiator, etc., to form an electrostatic latent image thereon. The electrostatic latent image is developed with a toner in the developing device 23, and then the toner image is transferred onto a transfer material which is timely fed from a feeding part to an area formed between the photoreceptor 21 and the transfer device so as to meet the toner images on the photoreceptor 21. The transfer material having the toner images thereon is separated from the photoreceptor 21 and transported to a fixing device so that the toner image is fixed and discharged from the image forming apparatus as a copying or a printing. After the toner image is transferred, residual toner particles remaining on the photoreceptor are removed using the cleaning device 24, and then the photoreceptor is discharged. The photoreceptor 21 is used repeatedly.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Polyester

The following components are fed in a reaction vessel equipped with a condenser, a stirrer and a nitrogen inlet pipe.

| | |
|---|---|
| Ethylene oxide (2 mole) adduct of bisphenol A | 553 parts |
| Propylene oxide (3 mole) adduct of bisphenol A | 196 parts |
| Terephthalic acid | 220 parts |
| Adipic acid | 45 parts |
| Dibutyltin oxide | 2 parts |

The mixture is reacted for 8 hours at 230° C. under normal pressure. Then the reaction is further continued for 5 hours under a reduced pressure of from 10 to 15 mmHg. Further, 26 parts of trimellitic anhydride is fed to the vessel to be reacted with the reaction product for 2 hours at 180° C. Thus, a polyester (P-1) is prepared.

The polyester (P-1) has a number average molecular weight (Mn) of 2,200, a weight average molecular weight (Mw) of 5,600, a glass transition temperature (Tg) of 43° C., and an acid value of 13 mgKOH/g.

Preparation of Particulate Vinyl Copolymer Resin

In a reaction vessel equipped with a condenser, a stirrer and a nitrogen inlet pipe, 1.6 parts of sodium dodecyl sulfate and 492 parts of ion-exchange water are contained and the mixture is heated to 80° C. Then a mixture of 2.5 parts of potassium persulfate and 100 parts of ion-exchange water are added thereto. After 15-minutes left, a mixture of the following components is gradually added thereto over a period of 90 minutes.

| | |
|---|---|
| Styrene monomer | 140 parts |
| Butyl acrylate | 30 parts |
| Methacrylic acid | 30 parts |
| n-Octyl mercaptan | 7.6 parts |

The mixture is kept for 60 minutes at 80° C., and then cooled down. Thus, an aqueous dispersion of a particulate vinyl copolymer resin (S-1) is prepared.

The particulate vinyl copolymer resin (S-1) has an average particle diameter of 87 nm. Apart of the dispersion is contained in a petri dish so that a dispersion medium (i.e., water) is removed and a solid material (i.e., particulate vinyl copolymer resin) can be obtained. The particulate vinyl copolymer resin (S-1) has a weight average molecular weight (Mw) of 8,300 and a glass transition temperature (Tg) of 69° C.

The procedure for preparation of the particulate vinyl copolymer resin (S-1) is repeated except for changing the components to those for particulate vinyl copolymer resins (S-2) to (S-6), respectively, described in Table 1.

TABLE 1

| Particulate vinyl copolymer resin | Components (parts by weight) St | BA | MAA | NOM | KPS | Average particle diameter (μm) | Mw | Tg (° C.) |
|---|---|---|---|---|---|---|---|---|
| S-1 | 140 | 30 | 30 | 7.6 | 2.5 | 87 | 8,300 | 69 |
| S-2 | 146 | 34 | 20 | 5.8 | 2.5 | 70 | 11,300 | 63 |
| S-3 | 152 | 38 | 10 | 4.1 | 2.5 | 57 | 14,300 | 58 |
| S-4 | 152 | 38 | 10 | 3.5 | 2.5 | 50 | 18,000 | 65 |
| S-5 | 152 | 38 | 10 | 2.8 | 2.5 | 50 | 24,000 | 68 |
| S-6 | 155 | 41 | 4 | 2.8 | 2.5 | 50 | 24,000 | 68 |

The abbreviated names of the components are as follows.
St: Styrene
BA: Butyl acrylate
MAA: Methacrylic acid
NOM: n-Octyl mercaptan (Molecular weight controlling agent)
KPS: Potassium persulfate (Polymerization initiator)

Preparation of Prepolymer

The following components are fed in a reaction vessel equipped with a condenser, a stirrer and a nitrogen inlet pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture is reacted for 8 hours at 230° C. under normal pressure. Then the reaction is further continued for 5 hours under a reduced pressure of from 10 to 15 mmHg. Thus, an intermediate polyester resin (1) is prepared. The intermediate polyester (1) has a number average molecular weight (Mn) of 2,100, a weight average molecular weight (Mw) of 9,500, a glass transition temperature (Tg) of 55° C., an acid value of 0.5 mgKOH/g, and a hydroxyl value of 49 mgKOH/g.

In a reaction vessel equipped with a condenser, a stirrer and a nitrogen inlet pipe, 411 parts of the intermediate polyester resin (1), 89 parts of isophorone diisocyanate, and 500 parts of ethyl acetate are mixed and the mixture is heated at 100° C. for 5 hours to perform the reaction. Thus, a polyester prepolymer (1) having an isocyanate group is prepared. A ratio of free isocyanate group included in the polyester prepolymer (1) is 1.53% by weight.

Preparation of Master Batch

Preparation of Master Batch (1K)

The following components are mixed using a HENSCHEL MIXER.

| | |
|---|---|
| Carbon black (REGAL 400R from Cabot Corp.) | 40 parts |
| Polyester resin (RS-801 from Sanyo Chemical Industries Ltd., having an acid value of 10 mgKOH/g, Mw of 20,000, and Tg of 64° C.) | 60 parts |
| Water | 30 parts |

The mixture is kneaded with a two-roll mill for 45 minutes at 130° C., and then pulverized into particles having a particle diameter of 1 mm using a pulverizer. Thus, a master batch (1K) is prepared.

Preparation of Master Batch (1Y)

The procedure for preparing the master batch (1K) is repeated except 40 parts of the carbon black is replaced with 25 parts of a yellow colorant C. I. Pigment Yellow 180 (PV FAST YELLOW HG from Clariant K. K.). Thus, a master batch (1Y) is prepared.

Preparation of Master Batch (1M)

The procedure for preparing the master batch (1K) is repeated except 40 parts of the carbon black is replaced with 20 parts of a magenta colorant C. I. Pigment Red 122 (HOSTAPERM PINK E from Clariant K. K.). Thus, a master batch (1M) is prepared.

Preparation of Master Batch (1C)

The procedure for preparing the master batch (1K) is repeated except 40 parts of the carbon black is replaced with 10 parts of a cyan colorant C. I. Pigment Blue 15:3 (LIONOL BLUE FG-7351 from Toyo Ink Mfg. Co., Ltd.) Thus, a master batch (1C) is prepared.

Example 1

Preparation of Colorant/Wax Dispersion

In a reaction vessel equipped with a stirrer and a thermometer, 543.5 parts of the polyester (P-1), 181 parts of a carnauba wax, and 1450 parts of ethyl acetate are mixed and the mixture is heated to 80° C. while agitated. After being heated at 80° C. for 5 hours, the mixture is cooled to 30° C. over a period of 1 hour. Then 500 parts of the master batch (1K) and 100 parts of ethyl acetate are added to the vessel, and the mixture is agitated for 1 hour to prepare a raw material mixture liquid (1).

Then 1500 parts of the raw material mixture liquid (1) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 655 parts of a 65% ethyl acetate solution of the polyester (P-1) are added thereto. The mixture is subjected to the dispersion treatment using the bead mill. The dispersion conditions are the same as those mentioned above except that the dispersion operation is performed once (i.e., one pass). Some ethyl acetate is added thereto so that the mixture has a solid content of 50% by weight (at 130° C.×3) Thus, a colorant/wax dispersion (1) is prepared.

Preparation of Water Phase 968 parts of ion-exchange water, 40 parts of a 25% by weight of aqueous solution of a particulate resin (a copolymer of styrene-methacrylic acid-butyl acrylate-sodium salt of a sulfuric acid ester of ethylene oxide adduct of methacrylic acid) serving as a dispersion stabilizer, 150 parts of a 48.5% by weight of aqueous solution of a sodium salt of dodecyldiphenyl ether disulfonic acid (ELEMINOL MON-7 from Sanyo Chemical Industries Ltd.), and 98 parts of ethyl acetate are mixed. As a result, a milky liquid is prepared. Thus, a water phase (1) is prepared.

Emulsification

Then the following components are mixed in a vessel.

| | |
|---|---|
| Colorant/wax dispersion (1) | 976 parts |
| Isophorone diamine | 2.6 parts |

The components are mixed for 1 minute using a mixer TK HOMOMIXER (from Tokushu Kika Kogyo K.K.) at a revolution of 5,000 rpm. Then 89 parts of the prepolymer (1) is added thereto and mixed for 1 minute using a mixer TK HOMOMIXER (from Tokushu Kika Kogyo K.K.) at a revolution of 5,000 rpm.

Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (1) is prepared.

Solvent Removal

The emulsion (1) is fed into a container equipped with a stirrer and a thermometer, and the emulsion is heated for 8 hours at 30° C. to remove the organic solvent therefrom. Thus, a dispersion (1-1) is prepared.

Adherence of Particulate Resin

The dispersion of the particulate vinyl copolymer resin (S-1) is added to the dispersion (1-1) so that the mixture has a solid content of 20% by weight. The mixture is heated to 73° C. over a period of 30 minutes. A mixture liquid of 100 parts of ion-exchange water and 100 parts of magnesium chloride hexahydrate is gradually added thereto and kept for 4 hours at 73° C. Then the mixture is controlled to have a pH of 5 by adding an aqueous solution of hydrochloric acid. The mixture is heated to 80° C. for 2 hours, and then cooled down. Thus, a dispersion (1-2) is prepared.

Washing and Drying

One hundred (100) parts of the dispersion (1-2) is filtered under a reduced pressure.

The thus obtained wet cake is mixed with 100 parts of ion-exchange water and the mixture is agitated for 10 minutes with a TK HOMOMIXER at a revolution of 12,000 rpm, followed by filtering. Thus, a wet cake (1) is prepared.

The wet cake (1) is mixed with 900 parts of ion-exchange water and the mixture is agitated for 30 minutes with a TK HOMOMIXER at a revolution of 12,000 rpm under application of an ultrasonic wave, followed by filtering under a reduced pressure. This washing operation is repeated until the mixture (i.e., re-slurry liquid) has an electric conductivity of not greater than 10 μC/cm. Thus, a wet cake (2) is prepared.

A re-slurry liquid of the wet cake (2) is mixed with a 10% aqueous solution of hydrochloric acid so that the re-slurry liquid has a pH of 4. The re-slurry liquid is agitated for 30 minutes with a stirrer, followed by filtering. Thus, a wet cake (3) is prepared.

The wet cake (3) is mixed with 100 parts of ion-exchange water and the mixture is agitated for 10 minutes with a TK HOMOMIXER at a revolution of 12,000 rpm, followed by filtering. This washing operation is repeated until the mixture (i.e., re-slurry liquid) has an electric conductivity of not greater than 10 μC/cm. Thus, a wet cake (4) is prepared.

The wet cake (4) is dried for 48 hours at 45° C. using a circulating air drier, followed by sieving with a screen having openings of 75 μm. Thus, mother toner particles (1K) are prepared. The mother toner particles (1K) have a volume average particle diameter (Dv) of 5.7 μm, a number average particle diameter (Dn) of 5.0 μm, a particle diameter distribution Dv/Dn of 1.14, and an average circularity of 0.980.

Adherence of External Additive

Then 100 parts of the mother toner particles (1K) are mixed with 0.5 parts of a hydrophobized silica having a BET specific surface area of 200 $m^2/g$ and 0.5 parts of another hydrophobized silica having a BET specific surface area of 50 $m^2/g$ using a HENSCHEL MIXER FM20C/I (from Mitsui Mining Co., Ltd.) for 5 minutes.

The HENSCHEL MIXER is equipped with an upper blade A0 and a lower blade ST. The peripheral speed of the tip of the lower blade is fixed at 40 m/sec.

Thus, a toner (1K) is prepared. The procedure for preparation of the toner (1K) is repeated except that the mother toner particles (1K) is replaced with mother toner particles (1Y), (1M), and (1C), respectively. Thus, toners (1Y), (1M), and (1C) are prepared.

Example 2, 3

The procedure for preparation of the toner (1K) is repeated except that the particulate vinyl copolymer resin (S-1) is replaced with (S-2) and (S-3), respectively. Thus, toners (2K) and (3K) are prepared.

The procedure for preparation of the toner (2K) is repeated except that master batch (1K) is replaced with master batches (1Y), (1M), and (1C), respectively. Thus, toners (2Y), (2M) and (2C) are prepared.

The procedure for preparation of the toner (3K) is repeated except that master batch (1K) is replaced with master batches (1Y), (1M), and (1C), respectively. Thus, toners (3Y), (3M) and (3C) are prepared.

Example 4

Preparation of Colorant/Wax Dispersion

In a reaction vessel equipped with a stirrer and a thermometer, 543.5 parts of the polyester (P-1), 181 parts of a carnauba wax, and 1450 parts of ethyl acetate are mixed and the mixture is heated to 80° C. while agitated. After being heated at 80° C. for 5 hours, the mixture is cooled to 30° C. over a period of 1 hour. Then 500 parts of the master batch (1K) and 10 parts of ethyl acetate are added to the vessel, and the mixture is agitated for 1 hour to prepare a raw material mixture liquid (2).

Then 1500 parts of the raw material mixture liquid (2) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 538 parts of a 65% ethyl acetate solution of the polyester (P-1) are added thereto. The mixture is subjected to the dispersion treatment using the bead mill. The dispersion conditions are the same as those mentioned above except that the dispersion operation is performed once (i.e., one pass). Some ethyl acetate is added thereto so that the mixture has a solid content of 50% by weight (at 130° C.×3) Thus, a colorant/wax dispersion (2) is prepared.

Emulsification

Then 976 parts of the colorant/wax dispersion (2) are mixed for 1 minute using a mixer TK HOMOMIXER (from Tokushu Kika Kogyo K.K.) at a revolution of 5,000 rpm. Then 1200 parts of the water phase (1) is added thereto. The mixture is agitated for 20 minutes with a mixer TK HOMOMIXER (from Tokushu Kika Kogyo K.K.) at a revolution of from 8,000 to 13,000 rpm. Thus, an emulsion (2) is prepared.

Solvent Removal

The emulsion (2) is fed into a container equipped with a stirrer and a thermometer, and the emulsion is heated for 8 hours at 30° C. to remove the organic solvent therefrom. Thus, a dispersion (2-1) is prepared.

Adherence of Particulate Resin

The dispersion of the particulate vinyl copolymer resin (S-1) is added to the dispersion (2-1) so that the mixture has a solid content of 20% by weight. The mixture is heated to 73° C. over a period of 30 minutes. A mixture liquid of 100 parts of ion-exchange water and 100 parts of magnesium chloride hexahydrate is gradually added thereto and kept for 6 hours at 73° C. Then the mixture is controlled to have a pH of 5 by adding an aqueous solution of hydrochloric acid. The mixture is heated to 80° C. for 2 hours, and then cooled down. Thus, a dispersion (2-2) is prepared.

The procedure for preparation of the toner (1K) in Example 1 is repeated except that the dispersion (1-2) is replaced with the dispersion (2-2). Thus, a toner (4K) is prepared.

The procedure for preparation of the toner (4K) is repeated except that the master batch (1K) is replaced with master batches (1Y), (1M), and (1C), respectively. Thus, toners (4Y), (4M) and (4C) are prepared.

Example 5, 6

The procedure for preparation of the toner (4K) in Example 4 is repeated except that the particulate vinyl copolymer resin (S-1) is replaced with (S-3) and (S-4), respectively. Thus, toners (5K) and (6K) are prepared.

The procedure for preparation of the toner (5K) is repeated except that the master batch (1K) is replaced with master batches (1Y), (1M), and (1C), respectively. Thus, toners (5Y), (5M), and (5C) are prepared.

The procedure for preparation of the toner (6K) is repeated except that the masterbatch (1K) is replaced with master batches (1Y), (1M), and (1C), respectively. Thus, toners (6Y), (6M) and (6C) are prepared.

Example 7

The procedure for preparation of the toner (5K) in Example 5 is repeated except that the dispersion of the particulate vinyl copolymer resin (S-3) is added to the dispersion (2-1) so that the mixture has a solid content of 10% by weight. Thus, toner (7K) is prepared.

The procedure for preparation of the toner (7K) is repeated except that the master batch (1K) is replaced with master batches (1Y), (1M), and (1C), respectively. Thus, toners (7Y), (7M) and (7C) are prepared.

Example 8

The procedure for preparation of the toner (1K) in Example 1 is repeated except that the added amounts of the hydrophobized silicas each having a BET specific surface area of 200 $m^2/g$ and 50 $m^2/g$ are changed from 0.5 parts to 0.3 parts. Thus, a toner (8K) is prepared.

The procedure for preparation of the toner (8K) is repeated except that the master batch (1K) is replaced with master batches (1Y), (1M), and (1C), respectively. Thus, toners (8Y), (8M) and (8C) are prepared.

Comparative Example 1

The procedure for preparation of the toner (1K) in Example 1 is repeated except that the shell is not formed (i.e., the particulate copolymer resin is not adhered to the core) and the hydrophobized silicas each having a BET specific surface area of 200 $m^2/g$ and 50 $m^2/g$ are not added. Thus, a comparative toner (9K) is prepared.

The procedure for preparation of the toner (9K) is repeated except that the master batch (1K) is replaced with master batches (1Y), (1M) and (1C), respectively. Thus, toners (9Y), (9M) and (9C) are prepared.

Comparative Example 2

The procedure for preparation of the toner (4K) in Example 4 is repeated except that the shell is not formed (i.e., the particulate copolymer resin is not adhered to the core) and the hydrophobized silicas each having a BET specific surface area of 200 $m^2/g$ and 50 $m^2/g$ are not added. Thus, a comparative toner (10K) is prepared.

The procedure for preparation of the toner (10K) is repeated except that the master batch (1K) is replaced with master batches (1Y), (1M), and (1C), respectively. Thus, toners (10Y) (10M), and (10C) are prepared.

Comparative Example 3

The procedure for preparation of the toner (5K) in Example 5 is repeated except that the dispersion of the particulate vinyl copolymer resin (S-3) is added to the dispersion (2-1) so that the mixture has a solid content of 2% by weight. Thus, toner (11K) is prepared.

The procedure for preparation of the toner (11K) is repeated except that the master batch (1K) is replaced with master batches (1Y), (1M), and (1C), respectively. Thus, toners (11Y) (11M), and (11C) are prepared.

Comparative Example 4

Preparation of Colorant Dispersion

In a vessel, 50 parts of a carbon black (REGAL 400R from Cabot Corp.), 33 parts of a 48.5% by weight of aqueous solution of a sodium salt of dodecyldiphenyl ether disulfonic acid, and 587 parts of ion-exchange water are fed and mixed using TK HOMOMIXER. Thus, a colorant dispersion is prepared.

Preparation of Wax Dispersion

In a vessel, 50 parts of a carnauba wax, 25 parts of a 48.5% by weight of aqueous solution of a sodium salt of dodecyldiphenyl ether disulfonic acid, and 275 parts of ion-exchange water are fed and mixed using TK HOMOMIXER. The mixture is subjected to a dispersion treatment using a bead mill (dispersion media: zirconia beads with a diameter of 0.5 mm). Thus, a colorant dispersion is prepared.

Aggregation

The following components are fed in a vessel.

| | |
|---|---|
| Dispersion of particulate vinyl copolymer resin (S-5) | 1600 parts |
| Colorant dispersion | 474 parts |
| Wax dispersion | 225 parts |
| Ion-exchange water | 2300 parts |

The mixture is controlled to have a pH of 6 by adding an aqueous solution of sodium hydroxide while agitated. Then the mixture is heated to 45 to 50° C. and an aqueous solution of sodium hydroxide is gradually added thereto while observing an aggregation condition. When the aggregated particles have an average particle diameter of about 5.0 μm, 40 parts of a 48.5% by weight of aqueous solution of a sodium salt of dodecyldiphenyl ether disulfonic acid are added thereto. Further, the mixture is controlled to have a pH of 5. Thus, a dispersion (3-1) is prepared.

Adherence of Particulate Resin

The dispersion of the particulate vinyl copolymer resin (S-6) is added to the dispersion (3-1) so that the mixture has a solid content of 20% by weight. The mixture is heated to 73° C. over a period of 30 minutes. A mixture liquid of 100 parts of ion-exchange water and 100 parts of magnesium chloride hexahydrate is gradually added thereto and kept for 5 hours at 73° C. Then the mixture is controlled to have a pH of 5 by adding an aqueous solution of hydrochloric acid. The mixture is heated to 80° C. for 2 hours, and then cooled down. Thus, a dispersion (3-2) is prepared.

The procedure for preparation of the toner (1K) in Example 1 is repeated except that the dispersion (1-2) is replaced with the dispersion (3-2). Thus, a toner (12K) is prepared.

The procedure for preparation of the toner (12K) is repeated except that 50 parts of the carbon black (REGAL 400R from Cabot Corp.) is replaced with 30 parts a yellow colorant C. I. Pigment Yellow 180 (PV FAST YELLOW HG from Clariant K. K.), 25 parts of a magenta colorant C. I. Pigment Red 122 (HOSTAPERM PINK E from Clariant K. K.), and 12 parts of a cyan colorant C. I. Pigment Blue 15:3 (LIONOL BLUE FG-7351), respectively. Thus, toners (12Y), (12M), and (12C) are prepared.

Measurement of Toner Properties

Particle Diameter

The volume average particle diameter (Dv), number average particle diameter (Dn), and particle diameter distribution of a toner can be measured using an instrument COULTER COUNTER TA-II or COULETR MULTISIZER II from Coulter Electrons Inc.

The typical measuring method is as follows:

(1) 0.1 to 5 ml of a surfactant (preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the volume average particle diameter (Dv) and the weight average particle diameter (Dn) is determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

Average Circularity

The shape of a particle is preferably determined by an optical detection method such that an image of the particle is optically detected by a CCD camera and analyzed. A particle suspension passes the image detector located on the flat plate so as to be detected.

The circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

The average circularity of a toner can be determined using a flow-type particle image analyzer FPIA-2000 manufactured by Sysmex Corp. The typical measurement method is as follows:

(1) 0.1 to 0.5 ml of a surfactant (preferably alkylbenzene sulfonate) is included as a dispersant in 100 to 150 ml of water from which solid impurities have been removed;

(2) 0.1 to 0.5 g of a toner is added to the electrolyte and dispersed using an ultrasonic dispersing machine for about 1 to 3 minutes to prepare a toner suspension liquid including 3,000 to 10,000 per 1 micro-liter of the toner particles; and (3) the average circularity and circularity distribution of the toner are determined by the measuring instrument mentioned above.

Molecular Weight

The molecular weight of the resins such as polyester-based resins and vinyl copolymer resins are determined by GPC (Gel Permeation Chromatography) method under the following conditions:

Instrument used: HLC-8220GPC (from Tosoh Corporation)

Column: TSKgel SuperHZM-M×3

Temperature: 40° C.

Solvent: THF (tetrahydrofuran)

Flow rate: 0.35 ml/min

Sample concentration: 0.05 to 0.6% by weight

Injection volume: 0.01 ml

The molecular weight of the resin is determined while comparing the molecular distribution curve thereof with the working curve which is previously prepared using 10 polystyrene standard samples each having a single molecular weight peak. Each of standard polystyrene has a molecular weight of from $5.8\times10^2$ to $7.5\times10^6$.

Glass Transition Temperature

The glass transition temperature of the resins such as polyester-based resins and vinyl copolymer resins are determined with a differential scanning calorimeter (DSC) such as DSC-6200 (from Seiko Instruments Inc.). The measurement method is as follows:

(1) a sample is heated from room temperature to 150° C. at a temperature rising rate of 10° C./min and left for 10 minutes at 150° C.;

(2) the sample is cooled to room temperature and left for 10 minutes; and (3) the sample is heated again from room temperature to 150° C. at a temperature rising rate of 10° C./min to obtain an endothermic curve (i.e., a relationship between temperature and amount of heat) of the sample.

The glass transition temperature is determined by finding an intersection point of the endothermic curve and the line which is drawn between the middle of two baselines of the endothermic curve.

Particle Diameter of Particulate Resin

The particle diameter of a particulate resin (such as a particulate vinyl copolymer resin) can be measured with particle size distribution analyzers such as LA-920 (from Horiba Ltd.) and UPA-EX150 (from Nikkiso Co., Ltd.), by subjecting the dispersion of the particulate resin to the measurement.

BET Specific Surface Area

The BET specific surface area can be measured by a multipoint method using nitrogen gas with a gas adsorption analyzer AUTOSORB-1-C (from Quantachrome Corporation).

Acid Value

The acid value of a toner can be measured according to JIS K-0070. The detailed measurement method is as follows:

(1) in a 300 ml beaker, 150 ml of a toluene/ethanol mixture (4/1 by volume) is fed and W (g) of a sample is dissolved therein;

(2) the above solution is titrated with a 0.1 mol/l KOH ethanol solution using a potentiometric titrator such as AT-400 (win workstation) equipped with an electric burette ABP-410 (both from Kyoto Electronics Manufacturing Co., Ltd.);

(3) a blank is also titrated in the same manner; and (4) the acid value is calculated by the following equation;

$$AV=\{(S-B)\times f\times 5.61\}/W$$

wherein AV (mgKOH/g) represents an acid value, S (ml) represents a titer of the sample, B (ml) represents a titer of the blank, f represents a factor of the 0.1 mol/l KOH ethanol solution, and W (g) represents the amount of the sample.

Since each of the black, yellow, magenta, and cyan toners in each Example is much the same, the measurement results of toner properties of the black toners are shown in Tables 2 and 3 as representatives.

TABLE 2

| | Core | Shell | Weight ratio (%) (Core/Shell) | External additive (parts) | Dv (μm) | Dn (μm) | Dv/Dn | Average circularity | Acid value (mgKOH/g) |
|---|---|---|---|---|---|---|---|---|---|
| Ex. 1 | p-1*) + HP**) | S-1 | 20 | 1.0 | 5.7 | 5.0 | 1.14 | 0.980 | 13 |
| Ex. 2 | P-1 + HP | S-2 | 20 | 1.0 | 5.6 | 4.9 | 1.14 | 0.977 | 12 |
| Ex. 3 | P-1 + HP | S-3 | 20 | 1.0 | 5.6 | 4.9 | 1.14 | 0.976 | 11 |
| Ex. 4 | P-1 | S-1 | 20 | 1.0 | 5.8 | 5.2 | 1.12 | 0.980 | 13 |
| Ex. 5 | P-1 | S-3 | 20 | 1.0 | 5.9 | 5.1 | 1.16 | 0.975 | 11 |
| Ex. 6 | P-1 | S-4 | 20 | 1.0 | 5.7 | 5.0 | 1.14 | 0.972 | 11 |
| Ex. 7 | P-1 | S-3 | 10 | 1.0 | 5.5 | 5.0 | 1.10 | 0.970 | 12 |
| Ex. 8 | P-1 | S-1 | 20 | 0.6 | 5.8 | 5.2 | 1.12 | 0.980 | 13 |
| Comp. Ex. 1 | P-1 + HP | — | — | — | 5.9 | 5.3 | 1.11 | 0.971 | 13 |
| Comp. Ex. 2 | P-1 | — | — | — | 5.6 | 4.9 | 1.14 | 0.975 | 13 |
| Comp. Ex. 3 | P-1 | S-3 | 2 | 1.0 | 5.7 | 5.1 | 1.12 | 0.976 | 13 |
| Comp. Ex. 4 | S-5 | S-6 | 20 | 1.0 | 5.2 | 5.2 | 1.19 | 0.981 | 4 |

P-1*): polyester resin (P-1)
HP**): modified polyester resin

TABLE 3

| | BET specific surface area ($m^2g$) | Adsorbed amount of $NH_3$ (μmol/g) | Adsorbed amount of $CO_2$ (μmol/g) | Adsorbed amount of $NH_3$ per unit of specific surface area (μmol/$m^2$) | Adsorbed amount of $CO_2$ per unit of specific surface area (μmol/$m^2$) |
|---|---|---|---|---|---|
| Ex. 1 | 2.32 | 571 | 0 | 246 | 0 |
| Ex. 2 | 2.23 | 415 | 0 | 186 | 0 |
| Ex. 3 | 2.18 | 220 | 0 | 101 | 0 |
| Ex. 4 | 2.28 | 592 | 0 | 260 | 0 |
| Ex. 5 | 2.25 | 208 | 0 | 92 | 0 |
| Ex. 6 | 2.31 | 213 | 0 | 92 | 0 |
| Ex. 7 | 2.35 | 201 | 0 | 86 | 0 |
| Ex. 8 | 1.87 | 585 | 0 | 313 | 0 |
| Comp. Ex. 1 | 2.51 | 113 | 0 | 45 | 0 |
| Comp. Ex. 2 | 2.47 | 105 | 0 | 43 | 0 |
| Comp. Ex. 3 | 2.42 | 147 | 0 | 61 | 0 |
| Comp. Ex. 4 | 2.26 | 52 | 0 | 23 | 0 |

Evaluations

The toners are subjected to the following evaluations as a one-component developer.

Background Fouling

Four-color toners are set in IPSIO CX2500 (from Ricoh Co. Ltd.) A running test in which 2,000 copies of a printing pattern (full-color image) having an image area proportion of 6% are continuously produced is performed at 23° C. and 45% RH. After the running test, the resultant images are visually observed to determine whether background fouling occurs or not. The evaluation is performed as follows:

Good: No background fouling occurs.

Average: Background fouling slightly occurs. No problem in practical use.

Poor: Background fouling occurs. Having problem in practical use.

Hollow Defect

Four-color toners are set in IPSIO CX2500 (from Ricoh Co., Ltd.). A running test in which 2,000 copies of a printing pattern (full-color image) having an image area proportion of 6% are continuously produced is performed at 23° C. and 45% RH. The bias is controlled so that 1.4 mg/cm$^2$ of a toner is adhered to the intermediate transfer medium when the printing pattern is produced. After the running test, the resultant images are visually observed to determine whether hollow defect occurs or not. The evaluation is performed as follows:

Good: No hollow defect occurs.

Average: Hollow defect slightly occurs. No problem in practical use.

Poor: Hollow defect seriously occurs. Having problem in practical use.

Cleanability

Four-color toners are set in IPSIO CX2500 (from Ricoh Co. Ltd.). A running test in which 2,000 copies of a printing pattern (full-color image) having an image area proportion of 6% are continuously produced is performed at 23° C. and 45% RH. After the running test, the photoreceptor and the intermediate transfer medium are visually observed to evaluate cleanability. The evaluation is performed as follows:

Good: No toner particles remain and no toner film is formed on both the photoreceptor and the intermediate transfer medium.

Average: Toner particles slightly remain and toner films are slightly formed on the photoreceptor and/or the intermediate transfer medium. No problem in practical use.

Poor: Toner particles remain and toner films are formed on the photoreceptor and/or the intermediate transfer medium. Having problem in practical use.

Fixing Separativeness

Four-color toners are set in IPSIO CX2500 (from Ricoh Co., Ltd.). Unfixed 36 mm-wide full-color solid images (toner content: 9 g/m$^2$) are formed on the A4-size paper at a position of 3 mm behind the tip thereof while the A4-size paper is fed in the vertical direction. The unfixed images are fixed using a fixing device illustrated in FIG. 3 at a temperature of from 130° C. to 190° C. in 10° C. steps so that a toner-fixable temperature range can be determined. In the toner-fixable temperature range, separation of the paper from the heating roller is well performed, offset problem does not occur, and the image hardly peels off. The paper used for the evaluation has a basic weight of 45 g/m$^2$ and has a cross direction. The paper is fed in the vertical direction in which a paper having a cross direction has a disadvantage for the paper separation. The feeding speed of the fixing device is 120 mm/sec.

Figure 3:
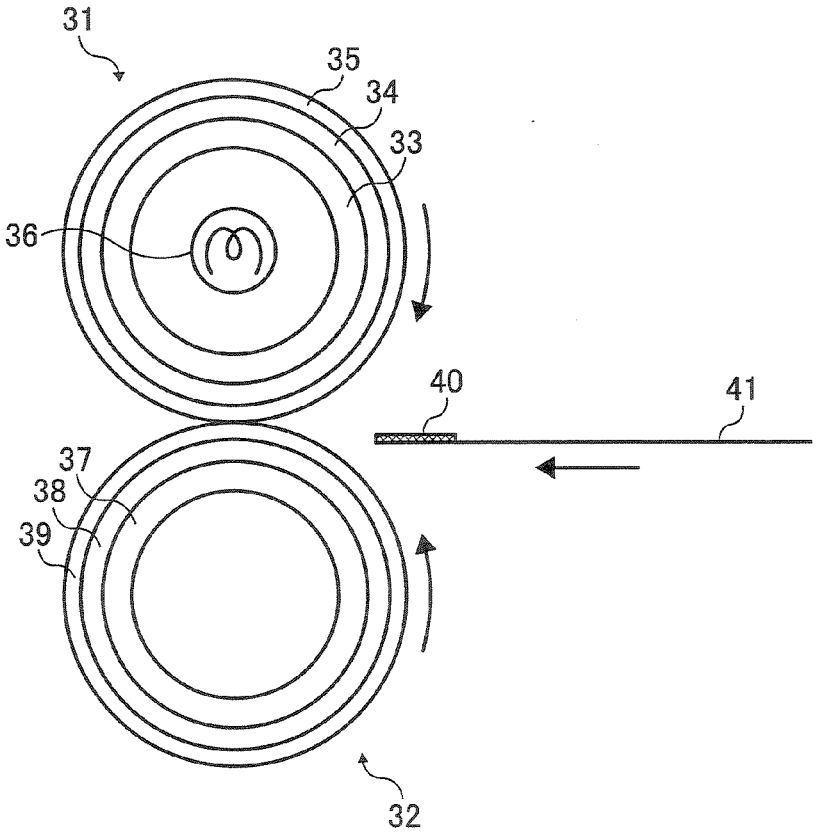
FIG. 3 is a schematic view illustrating an embodiment of a fixing device for fixing the toner of the present invention.

FIG. 3 is a schematic view illustrating the fixing device used for the evaluation of the toner of the present invention. The fixing device includes a soft roller having a fluorinated outermost layer. In particular, a heating roller 31 having an external diameter of 40 mm includes:

an aluminum cored bar 33;

an elastic layer 34 having a thickness of 1.5 mm and including a silicone rubber, which is located on the aluminum cored bar 33;

an outermost layer 35 including PFA (tetrafluoroethylene-perfluoro (alkylvinyl) ether copolymer), which is located on the elastic layer 34; and a heater 36 which is located inside the aluminum cored bar.

A pressing roller 32 having an external diameter of 40 mm includes:

an aluminum cored bar 37;

an elastic layer 38 having a thickness of 1.5 mm and including a silicone rubber, which is located on the aluminum cored bar 37; and an outermost layer 39 including PFA, which is located on the elastic layer 38.

A paper 41 having an unfixed image 40 thereon is fed in the direction indicated by an arrow.

The fixing separativeness is graded as follows:

Good: The toner-fixable temperature range is not less than 50° C.

Average: The toner-fixable temperature range is not less than 30° C. and less than 50° C.

Poor: The toner-fixable temperature range is less than 30° C.

The evaluation results are shown in Table 4.

TABLE 4

| | Background fouling | Hollow defect | Cleanability | Fixing separativeness |
|---|---|---|---|---|
| Ex. 1 | Good | Good | Good | Good |
| Ex. 2 | Good | Good | Good | Good |
| Ex. 3 | Good | Good | Good | Good |
| Ex. 4 | Good | Good | Good | Good |
| Ex. 5 | Good | Good | Good | Good |
| Ex. 6 | Good | Good | Good | Good |
| Ex. 7 | Good | Good | Good | Good |
| Ex. 8 | Good | Good | Good | Good |
| Comp. Ex. 1 | Poor | Good | Average | Average |
| Comp. Ex. 2 | Poor | Poor | Poor | Poor |
| Comp. Ex. 3 | Poor | Good | Good | Good |
| Comp. Ex. 4 | Poor | Average | Good | Poor |

This document claims priority and contains subject matter related to Japanese Patent Application No. 2006-036864, filed on Feb. 14, 2006, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner prepared by a wet granulation method, comprising:

a binder resin; and a colorant, wherein the toner is a core-shell toner having a weight ratio of the shell to the core of not less the 0.05, and wherein the toner adsorbs ammonia ($NH_3$) in an amount of from 70 to 400 μmol/m$^2$ per unit of specific surface area and carbon dioxide ($CO_2$) in an amount of not greater than 10 μmol/m$^2$ per unit of specific surface area.

2. The toner according to claim 1, wherein the toner adsorbs ammonia ($NH_3$) in an amount of from 150 to 800 μmol/g and carbon dioxide ($CO_2$) in an amount of not greater than 10 μmol/g.

3. The toner according to claim 1, wherein the toner has a volume average particle diameter of from 3 to 8 μm.

4. The toner according to claim 1, further comprising a release agent.

5. The toner according to claim 1, wherein the binder resin comprises a resin having a polyester skeleton.

6. The toner according to claim 5, wherein the resin having a polyester skeleton has a glass transition temperature not less than 40° C.

7. The toner according to claim 5, wherein the resin having a polyester skeleton has at least one member selected from the group consisting of a urethane group and a urea group.

8. The toner according to claim 4, wherein the toner comprises the release agent which is a member selected from the group consisting of paraffins, synthesized esters, polyolefins, carnauba waxes, and rice waxes, in an amount of from 3 to 30% by weight.

9. The toner according to claim 1, further comprising an external additive.

10. The toner according to claim 9, wherein a product of a volume average particle diameter of the toner and a content of the external additive is from 3 to 20 μm·% by weight.

11. The toner according to claim 1, wherein the toner has an average circularity not less than 0.96.

12. The toner according to claim 1, wherein the core-shell structure has a shell comprising a vinyl copolymer resin.

13. The toner according to claim 12, wherein the shell is formed by a method, comprising:

adding an aqueous dispersion comprising a vinyl copolymer resin to an aqueous dispersion comprising core particles to adhere the vinyl copolymer resin to the core particles.

14. A developer, comprising the toner according to claim 1 and a carrier.

15. An image forming method, comprising:

forming an electrostatic latent image on an image bearing member;

developing the electrostatic latent image with a toner to form a toner image on the image bearing member;

transferring the toner image onto a recording medium; and fixing the toner image on the recording medium, wherein the toner is the toner according to claim 1.

16. An image forming apparatus, comprising:

an image bearing member configured to bear an electrostatic latent image;

a charger configured to charge the image bearing member;

an irradiator configured to irradiate the charged image bearing member with a light beam to form the electrostatic latent image thereon;

a developing device configured to develop the electrostatic latent image with a toner to form a toner image on the image bearing member;

a transfer device configured to transfer the toner image onto a recording medium; and a fixing device configured to fix the toner image on the recording medium, comprising a roller and a heater, wherein the toner is the toner according to claim 1.

17. The image forming apparatus according to claim 16, wherein the fixing device is an oilless fixing device.

18. A process cartridge, comprising:

an image bearing member configured to bear an electrostatic latent image; and a developing device configured to develop the electrostatic latent image with a toner to form a toner image on the image bearing member, wherein the toner is the toner according to claim 1.

19. The toner according to claim 1, wherein the shell comprises units obtained from acid monomers in an amount of not less than 5% by weight and units obtained from basic monomers in an amount of not greater than 0.5% by weight.

20. The toner according to claim 13, wherein the aqueous dispersion comprising core particles is prepared by dispersing a core constituent mixture liquid in an aqueous medium, and the core constituent mixture liquid is prepared by dissolving or dispersing core constituents comprising a colorant, a release agent, and at least one of a polyester-based resin and a precursor thereof in an organic solvent.

* * * * *